US007273270B2

(12) United States Patent
Katerberg

(10) Patent No.: US 7,273,270 B2
(45) Date of Patent: Sep. 25, 2007

(54) INK JET PRINTING DEVICE WITH IMPROVED DROP SELECTION CONTROL

(75) Inventor: James A. Katerberg, Kettering, OH (US)

(73) Assignee: Eastman Kodak Company, Rochester, NY (US)

( * ) Notice: Subject to any disclaimer, the term of this patent is extended or adjusted under 35 U.S.C. 154(b) by 103 days.

(21) Appl. No.: 11/229,456

(22) Filed: Sep. 16, 2005

(65) Prior Publication Data

US 2007/0064067 A1 Mar. 22, 2007

(51) Int. Cl.
*B41J 2/085* (2006.01)

(52) U.S. Cl. ..... 347/76; 347/80

(58) Field of Classification Search ..... None
See application file for complete search history.

(56) References Cited

U.S. PATENT DOCUMENTS

| | | | | |
|---|---|---|---|---|
| 3,949,410 | A | 4/1976 | Bassous et al. | |
| 4,180,225 | A | 12/1979 | Yamada | |
| 4,251,823 | A | 2/1981 | Sagae | |
| 4,347,519 | A | 8/1982 | Kikuchi et al. | |
| 4,510,503 | A * | 4/1985 | Paranjpe et al. | 347/14 |
| 4,596,990 | A | 6/1986 | Hou | |
| 4,613,871 | A | 9/1986 | Katerberg | |
| 4,656,489 | A * | 4/1987 | Sato et al. | 347/182 |
| 4,734,705 | A * | 3/1988 | Rezanka et al. | 347/75 |
| 4,849,909 | A | 7/1989 | Yamada et al. | |
| 4,972,201 | A | 11/1990 | Katerberg et al. | |
| 5,363,131 | A | 11/1994 | Momose et al. | |
| 6,244,693 | B1 * | 6/2001 | Misumi | 347/65 |
| 6,273,559 | B1 | 8/2001 | Vago et al. | |
| 6,945,638 | B2 * | 9/2005 | Teung et al. | 347/74 |
| 7,033,003 | B2 * | 4/2006 | Martin et al. | 347/75 |
| 2005/0185031 | A1 * | 8/2005 | Steiner et al. | 347/74 |
| 2006/0103699 | A1 * | 5/2006 | Hoisington et al. | 347/74 |
| 2006/0183261 | A1 * | 8/2006 | Dudenhoefer et al. | 438/48 |

FOREIGN PATENT DOCUMENTS

| | | |
|---|---|---|
| EP | 1 323 531 A1 | 7/2003 |

* cited by examiner

*Primary Examiner*—Lamson Nguyen
*Assistant Examiner*—Justin Seo
(74) *Attorney, Agent, or Firm*—The Buskof Law Group, PC

(57) ABSTRACT

An ink jet printing system includes a printhead generating a plurality of continuous ink jets that are in a row and directed toward a print receiving medium. The printhead contains a drop generator and an orifice plate that includes a plurality of nozzles to form the continuous ink jets. The orifice plate includes a stimulating device to produce first and second synchronous drop breakoffs in a phased relationship and each ink jet in the drop breakoffs alternate producing plurality of drops in a phased relationship. A charge plate is placed opposite the drop generator and includes a plurality of drop charging electrodes adjacent the continuous ink jets. A controller is in communication with each drop charging electrode and supplies a plurality of synchronized controlled drop selection pulses to the drop charging electrodes.

17 Claims, 3 Drawing Sheets

INK JET PRINTING DEVICE WITH IMPROVED DROP SELECTION CONTROL

CROSS REFERENCE TO RELATED APPLICATIONS

Reference is made to commonly assigned, U.S. patent application Ser. No. 11,229,467 filed concurrently herewith, entitled "INK JET BREAK-OFF LENGTH CONTROLLED DYNAMICALLY BY INDIVIDUAL JET STIMULATION," in the name of Gilbert A. Hawkins et al.; U.S. patent application Ser. No. 11,229,454 filed concurrently herewith, entitled "INK JET BREAK-OFF LENGTH MEASUREMENT APPARATUS AND METHOD," in the name of Gilbert A. Hawkins et al.; U.S. patent application Ser. No. 11,229,263 filed concurrently herewith, entitled "CONTINUOUS INK JET APPARATUS WITH INTEGRATED DROP ACTION DEVICES AND CONTROL CIRCUITRY," in the name of Michael J. Piatt, et al.; U.S. patent application Ser. No. 11,229,459 filed concurrently herewith, entitled "METHOD FOR DROP BREAKOFF LENGTH CONTROL IN A HIGH RESOLUTION INK JET PRINTER", in the name of Michael J. Piatt et al.; and U.S. patent application Ser. No 11/229,261 filed concurrently herewith, entitled "ELECTROSTATIC DEFLECTION WITH THERMAL STIMULATION", in the name of Michael J. Piatt, et al., the disclosures of all of which are incorporated herein by reference.

FIELD OF THE INVENTION

The present embodiments relate to ink jet drop control for continuous ink jet printers.

BACKGROUND OF THE INVENTION

In the current state of ink jet printers, a need exists to reduce cross talk between ink jet drops as the ink jet drops come from the orifice plate of the drop generator. In high resolution inkjet printers, drops are affected by the electronic fields produced from charging electrodes associated with nearby jets or adjacent jets, a phenomena known as crosstalk. Visible print defects occur from the cross talk. Further, printer versatility is highly reduced due to cross talk. U.S. Pat. No. 4,613,871, issued to the same inventor, which is incorporated by reference, teaches a current system for handling cross talk.

The present embodiments described herein were designed to meet these above needs.

SUMMARY OF THE INVENTION

An ink jet printing system includes a printhead generating a plurality of continuous ink jets that are in a row and directed toward a print receiving medium. The printhead contains a drop generator and an orifice plate that includes a plurality of nozzles to form the continuous ink jets. The orifice plate includes a stimulating device to produce first and second synchronous drop breakoffs in a phased relationship and each ink jet in the first drop breakoffs alternate with each ink jet in the second drop breakoffs producing a first plurality of drops in a phased relationship to a second plurality of drops. A charge plate is placed opposite the drop generator and includes a plurality of drop charging electrodes adjacent the continuous ink jets. A controller is in communication with each drop charging electrode and supplies a plurality of synchronized controlled drop selection pulses to the drop charging electrodes.

The drop generator includes a stimulating device adapted to stimulate a first group of ink jets to produce first synchronous drop breakoffs. The stimulating device stimulates a second group of ink jets to produce second synchronous drop breakoffs. The first drop breakoffs are in a phased relationship to the second drop breakoffs and each ink jet in the first drop breakoffs alternate with each ink jet in the second drop breakoffs producing a first plurality of drops in a phased relation to a second plurality of drops.

A charge plate is placed opposite the drop generator and includes a plurality of drop charging electrodes positioned adjacent the row of continuous ink jets. One or more drop charging electrodes are associated with each continuous ink jet. A controller is in communication with each drop charging electrode and the controller supplies a plurality of synchronized controlled drop selection pulses to the drop charging electrodes.

The synchronized controlled drop selection pulses are applied to the drop charging electrodes of the first group in a 180-degree phased relationship to the drop selection pulses applied to the drop charging electrodes of the second group. The drop selection pulses of the first drop breakoffs are separate from the drop selection pulses of the second drop breakoffs.

BRIEF DESCRIPTION OF THE DRAWINGS

In the detailed description of the example embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The present embodiments reduce the visible print errors that occur with cross talk charging.

The present embodiments relate to a novel ink jet printing system that generally improves the print latitude. The novel ink jet printing systems improve and widen the charge voltage range. This present embodiments reduce splash that occurs when the drop strikes the paper, which in turn reduces image quality.

Figure 1:
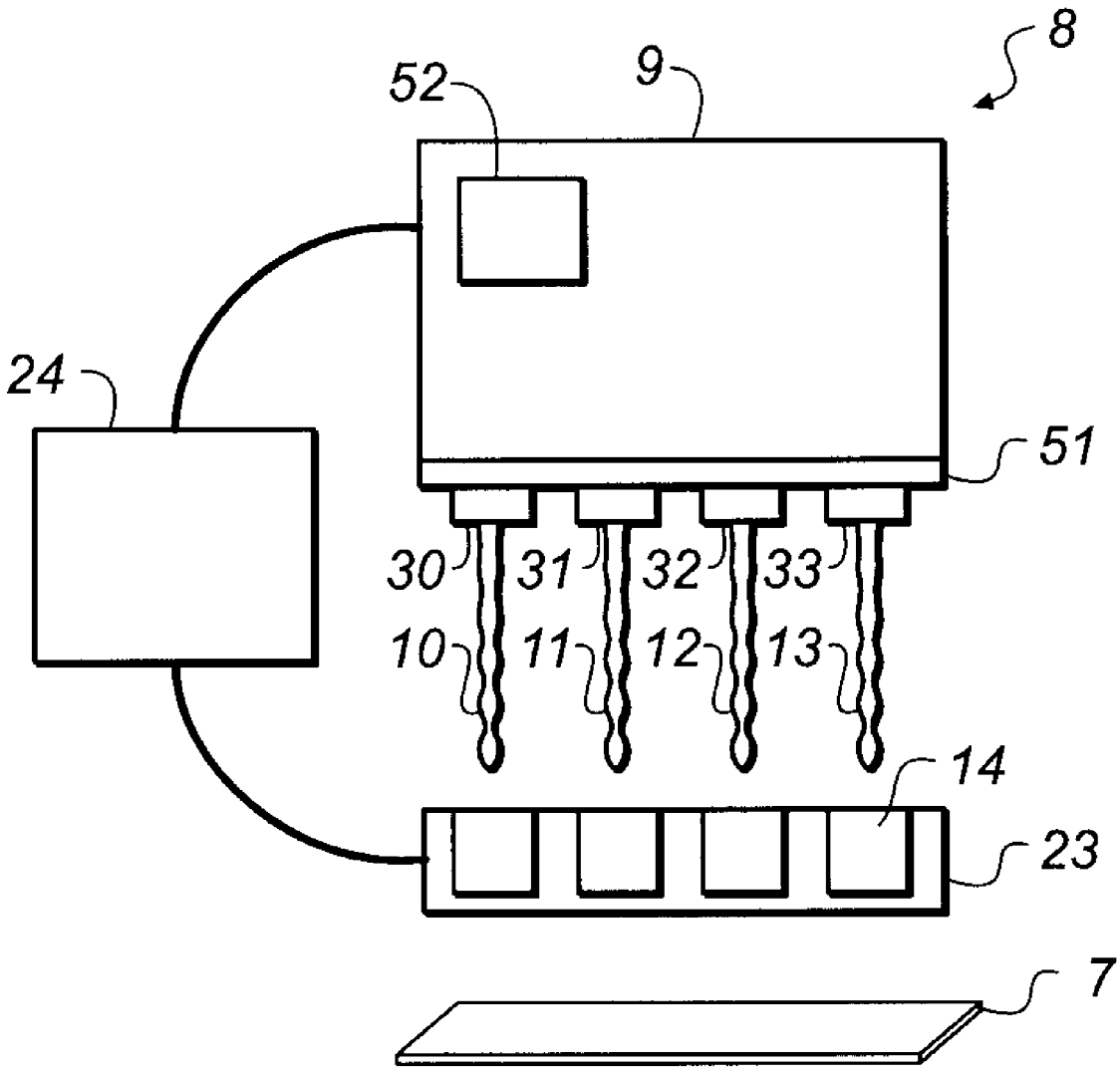
FIG. 1 is a schematic of a printhead useable in the embodied system.

With reference to the figures, FIG. 1 depicts a detail of the ink jet printing system with a printhead 8 with a drop generator 9, an orifice plate 51, and a charge plate 23. The printhead 8 includes continuous ink jets 10, 11, 12, and 13 that form a jet array. The continuous ink jets 10, 11, 12, and 13 are disposed in a row and directed toward a print receiving medium 7. The orifice plate 51 has a numerous nozzles 30, 31, 32, and 33 arranged in an array, wherein the ink emanating from the nozzles 30, 31, 32, and 33 form the continuous ink jets 10, 11, 12, and 13. The ink jet printing system includes one or more stimulating devices 52 that are used to stimulate the ink jets thereby producing synchronous drop breakoffs.

Each ink jet in the first group of synchronous drop breakoffs alternates with each ink jet in the second group of synchronous drop breakoffs producing a first plurality of drops in a phased relation to a second plurality of drops. This phased relationship is preferably between 135 and 225 degrees.

Continuing with FIG. 1, a charge plate 23 is disposed below the drop generator 9. The charge plate 23 comprises a plurality of drop charging electrodes. Each drop charging electrode is positioned adjacent an ink jet. Alternatively, the electrode 14 can be fabricated on the charge plate 23 on a face adjacent the ink jet 10. The electric field produced at the ink jet 10 by voltage applied to the electrode 14 at the time the ink jet emits a drop controls whether the created drop will continue on to the print receiving medium 7 (a print drop) or will be diverted away from the print receiving medium 7, caught, and recycled (a catch drop). Typically, voltage pulses, called drop selection pulses, are applied to the individual electrodes 14 to select whether the created drops are print drops or catch drops.

A controller 24 is in communication with each drop charging electrode. The controller 24 supplies a plurality of synchronized controlled drop selection pulses to the drop charging electrodes, such as electrode 14.

Figure 2A:
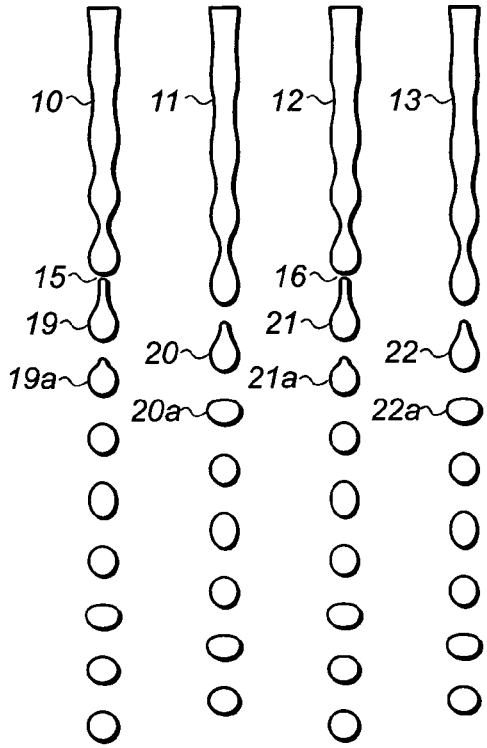
FIGS. 2*a* and 2*b* depict the breakoff of drop from two groups of ink jets.
Figure 2B:
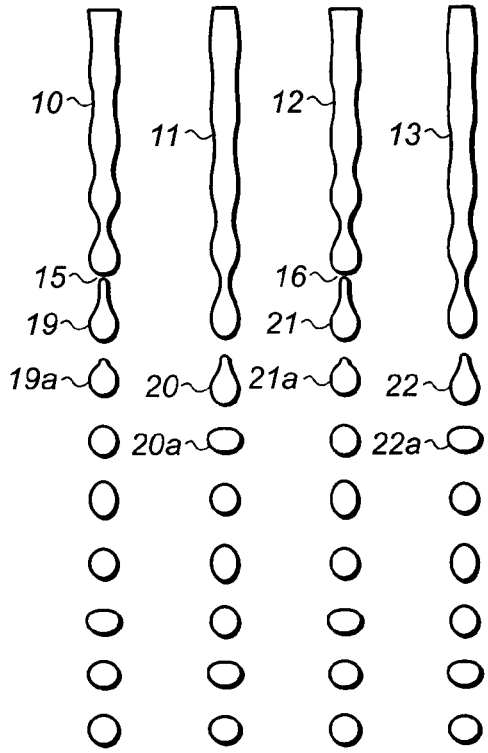

FIGS. 2*a* and 2*b* depict the breakoff of drop from two groups of ink jets. The first group of ink jets is made of ink jets 10 and 12. The second group of ink jets is made of ink jets 11 and 13. The stimulating device modulates the diameter of the ink jets as the ink jets emanate from the nozzles producing an alternating stream of bulges and narrowed regions on the ink jets. This process is known as stimulation. The modulation amplitude grows as the distance from the orifice plate increases, until the narrowed regions pinch the jet to produce a drop 19. FIGS. 2*a* and 2*b* depict depicts the drop breakoff point 15. The time between the breakoff of a drop 19 and the breakoff of the preceding drop 19*a* is the drop creation period.

The stimulating device is adapted to provide a first signal to stimulate the first group of ink jets 10 and 12 to synchronously produce bulges on all jets in the group and synchronously produce narrowed regions on all the jets in the group. As a result, the stimulating device produces a first group of nearly synchronous drop breakoffs 15 and 16. The stimulating device is further adapted to provide a second signal to stimulate the second group of ink jets 11 and 13 to synchronously produce bulges on all jets in the group and synchronously produce narrowed regions on all the jets in the group. As a result, the stimulating device produces a second group of nearly synchronous drop breakoffs. In one embodiment, the stimulating device is adapted to produce first and second signals that are out of phase such that the signals modulate the ink jets in the first group out of phase from the modulation of the ink jets in the second group. Modulating the first and second groups of ink jets at different phases produces a phase shift in the bulge and narrowed region pattern between the first and second group. As a result, the breakoff phases are different for the first and second groups of synchronous drop breakoffs.

In an alternative embodiment, the stimulating device is adapted to produce first and second signals that are in phase but differ in amplitude to modulate the ink jets of first and second groups in phase with each other. In this embodiment, the difference in signal amplitude between the first and second signals produces a difference in breakoff phase and also in breakoff length between the first and second groups, as depicted in FIG. 2*b*. As the two groups of jets are modulated in phase, the bulges on the ink jets for both groups of ink jets are aligned with each other. After breakoff, the rows of drops from the ink jets of both groups are aligned with each other.

In the example embodiments, each ink jet in the first group of synchronous drop breakoffs alternates with each ink jet in the second group of synchronous drop breakoffs producing a first plurality of drops in a phased relation to a second plurality of drops. This phased relationship is preferably between 135 and 225 degrees.

Figure 3:
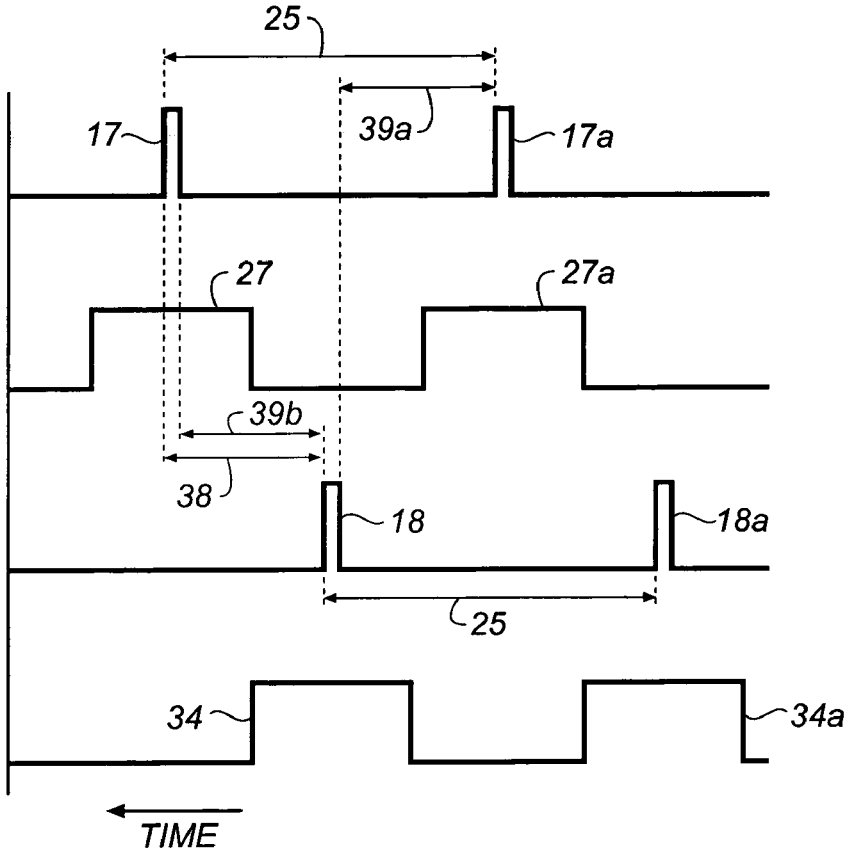
FIG. 3 is a timing diagram showing the relationship between the drop breakoff times for the first and second groups of inkjets

FIG. 3 is a timing diagram showing the relationship between the drop breakoff times for the first and second groups of inkjets. The first group of ink jets is shown to have first breakoff time 17 and a second breakoff time 17*a*. Relating FIG. 3 to FIG. 2*a*, the first breakoff time 17 corresponds to the time at which drop 19 breaks off from ink jet 10 and drop 21 breaks off from ink jet 12. The second breakoff time 17*a* corresponds to the time at which drop 19*a* breaks off from ink jet 10 and drop 21*a* breaks off from ink jet 12. The time between the first breakoff time 17 and second breakoff time 17*a*, also known as the drop creation period 25, is the time between the breakoff of a drop and the breakoff of the preceding drop.

The second group of ink jets is shown to have first breakoff time 18 and a second breakoff time 18*a*. Relating FIG. 3 to FIG. 2*a*, first breakoff time 18 correspond to the time at which drop 20 breaks off from ink jet 11 and drop 22 breaks off from ink jet 13. The second breakoff time 18*a* corresponds to the time at which drop 20*a* breaks off from ink jet 11 and drop 22*a* breaks off from ink jet 13. The time between the first breakoff time 18 and second breakoff time 18*a* is equal to the drop creation period 25.

Breakoff times 17, 17*a*, 18, and 18*a* have some width. From jet to jet within the first or second groups of synchronous drop breakoffs, the breakoff times are not perfectly synchronous. In practice, the breakoff times do not have to be perfectly synchronous as long as sufficient time 39*a* and 39*b* exists between the first and second groups of synchronous drop breakoffs.

FIG. 3 shows the timing relationship 38 between the first group of synchronous drop breakoffs and the second group of synchronous drop breakoffs. This timing relationship, also known as a phase relationship, between the first group of synchronous drop breakoffs and the second group of synchronous drop breakoffs corresponds to the timing relationship 38 divided by the drop creation period 25 times 360 degrees.

FIG. 3 shows synchronized controlled drop selection pulses. The synchronized controlled drop selection pulses 27 and 27*a* are applied to the drop charging electrodes associated with the ink jets of the first group of synchronized drop breakoffs. Drop selection pulse 27 controls the print or catch selection of drops breaking off at first breakoff time 17. Drop selection pulse 27*a* controls the print or catch selection of drops breaking off at second breakoff time 17*a*. The synchronized controlled drop selection pulses 34 and 34*a* are applied to the drop charging electrodes associated with the ink jets of the second group of synchronized drop breakoffs. Drop selection pulse 34 controls the print or catch selection of drops breaking off at first breakoff time 18 and drop selection pulse 34*a* controls the print or catch selection of drops breaking off at second breakoff time 18*a*.

The drop selection pulses have sufficient width to ensure that none of the drops breaking off from the associated ink jets breakoff during the rise and fall times of the drop selection pulses. The drop selection pulses associated with each group of synchronized drop breakoffs are synchronized with the breakoff times of the associated group so that the drop selection pulse encompasses the breakoff times for the associated group. Furthermore, the drop selection pulse width and timing are such that the drop selection pulse excludes the breakoff times for the non-associated group. Drop selection pulse 27 and 27*a* associated with the first group of synchronous drop breakoffs therefore do not coincide with the breakoff times 18 and 18*a* of the second group of synchronous drop breakoffs. Similarly, drop selection pulse 34 and 34*a* associated with the second group of synchronous drop breakoffs do not coincide with the breakoff times 17 and 17*a* of the first group of synchronous drop breakoffs. In this way the drop, selection pulses applied to a charge electrode can control the drop selection for the associated jet and do not affect the drop selection for jets adjacent to the associated jet. Each drop selection pulse is, therefore, phased and has a pulse width that prevents interference with the drop selection pulses applied to adjacent drop charging electrodes.

The phase relationship between the first group of synchronous drop breakoffs and the second group of synchronous drop breakoffs is preferably in the range of 135 degree to 225 degree, and more preferably is a 180 degree phased relationship. Preferably, the phased relationship between the drop selection pulses associated with the each group of synchronous drop breakoffs is the same as the phased relationship between the drop breakoff times for each group of synchronous drop breakoffs. The pulse width for the drop selections pulses associated with each group of synchronous drop breakoffs is preferably about 30% to 70% of the drop creation period. An overlap can occur between the drop selection pulses associated with each group of synchronous drop breakoffs. An overlap does not exists between drop selection pulses associated with a group of synchronous drop breakoffs and the breakoff times of jets adjacent to the ink jet in the group of synchronous drop breakoffs.

A third group of synchronized drop breakoffs can be utilized, wherein the group of synchronized drop breakoffs does not coincide with either the first or the second group. This third group is typically in a 90 degree to 150 degree phased relationship to the first and second groups. In an alternative embodiment, each drop selection pulse has a pulse width that prevents interference with the drop selection pulse used for the continuous ink jets adjacent to the drop selection pulse. A drop creation period is formed between the first drop of a group and an additional drop of that group.

The pulse width for each ink jet is preferably about 30% to 50% of the drop creation period. The variation in the drop creation period arises when a third group of synchronized drop breakoffs is created to use with the first and second group.

In one example embodiment, the stimulating device comprises an ElectroHydroDynamic (EHD) stimulating device, such as is known in the art. This embodiment employs a second set of control electrodes adjacent to the nozzles to produce electric fields at stimulate the jets to produce stable drop formation. This second set of control electrodes is disposed on a plate with at least one of the second set of drop charging electrodes adjacent to each nozzle, wherein the electrodes are periodically energized by associated electronics producing modulating electric fields at the ink jets. The modulating electric fields serve as a signal to affect drop stimulation for the associated jet. The electronics communicate with the controller and is synchronized with the controller.

These control electrodes comprise a first and a second group of control electrodes associated with first and second groups or inkjets respectively. The first and second groups of control electrodes are energized by the associated electronics to produce first group of synchronous drop breakoffs, and a second group of ink jets to produce a second group of synchronous drop breakoffs.

The present embodiments relate to a method for reducing cross talk in an ink jet printing system. The method begins be forming a plurality of continuous ink jets, stimulating a first group of ink jets to produce a first group of synchronous drop breakoffs, and stimulating a second group of ink jets to produce a second group of synchronous drop breakoffs. The second group of synchronous drop breakoffs is in a phased relationship to the first group of drop breakoffs, thereby producing drops in a phased relationship. The method continues by selectively charging the drops with electrodes on a charge plate, wherein each electrode is individually associated with an ink jet. Drop selection pulses are applied to the drop charging electrodes associated with the first group of ink jets in a 180 degrees phased relationship to the drop selection pulses. The drop selection pulses of the first group of ink jets do not affect the drops of the second group of ink jets.

Referring back to FIG. 3, the drop selection pulses 27, 27*a*, 34, and 34*a* are shown as positive going pulses away from ground potential. It should be understood, however, that drop selection pulses are data specific. That is, the voltage level for a given drop selection pulse is high when the data requires the drop to be charged and is low or grounded when the data requires the drop to uncharged. Furthermore, it should be understood that some inkjet printers employ positive charging voltages to charge selected drops while other inkjet printer employ negative charging voltages to charge selected drops. As such, the description of the drop selection pulse being high is intended to apply independently of the polarity of the drop selection pulses being employed.

Again referring back to FIG. 3, the voltage level between drop selection pulses is shown as low. In this configuration, the low voltage on the first group of charging electrodes does not contribute to the charging of drops in the second group of synchronous drop breakoffs. Alternatively, the voltage level between drop selection pulses can be held at a high level. By maintaining a voltage high level between drop selection pulses, the drop deflection fields produced by electrodes can be energized for a much higher duty cycle when compared to a voltage low level. This serves to increase the deflection of the charged ink drops. The voltage high level between drop selection pulses of the first group of drop charging electrodes can contribute to the charging of drops in the second group of synchronous drop breakoffs, however, the contribution will be the same for all drops. Either voltage level between drop selection pulses can be employed within the scope of this invention.

A stimulating device 52 is associated with the drop generator 9 to stimulate a first group of ink jets to produce a first group of synchronous drop breakoffs, as depicted in FIG. 1.

Figure 4:
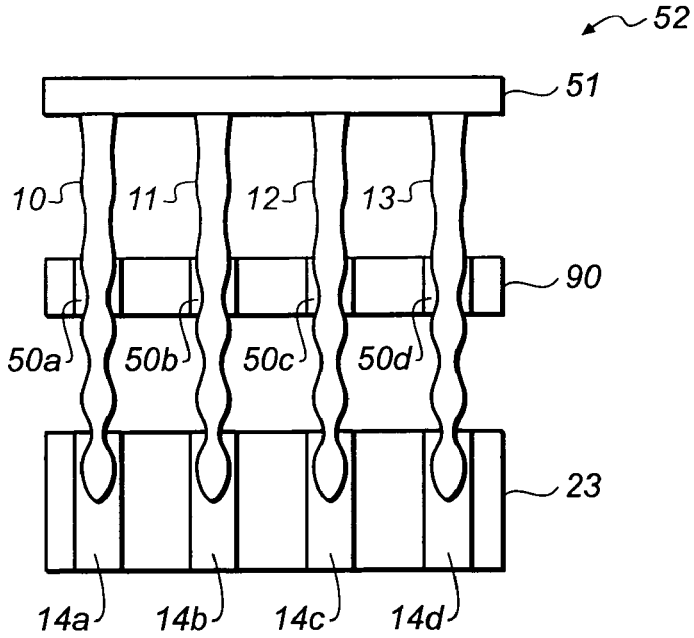
FIG. 4 is detailed size view of embodiment using a second set of electrodes on a plate as a stimulating device.

FIG. 4 is detailed size view of embodiment using a second set of electrodes 50*a*, 50*b*, 50*c*, and 50*d* on a second plate (stimulating device plate) 90, in addition to the orifice plate 51, as a stimulating device 52. When a periodic voltage of appropriate amplitude and frequency is applied to an electrode 50*a*, 50*b*, 50*c*, and 50*d*, the electric fields produced by the electrode stimulates the adjacent ink jet to produce drop breakoff. By energizing a first set of electrodes 50*a* and 50*c* with a periodic voltage at one phase and amplitude and energizing a second set of electrodes 50*b* and 50*d* with a periodic voltage at the same amplitude but at a second phase, the stimulating device 52 causes a first group of jets 10 and 12 to have synchronous drop breakoffs and causes a second group of ink jets 11 and 13 to produce a second group of synchronous drop breakoffs. The first group of ink jets 10 and 12 provides the first group of synchronous drop breakoffs in a phased relationship to the second group of synchronous drop breakoffs of the second group of ink jets 11 and 13. If the electrodes associated with the first and second groups of ink jets 10 and 12, 11 and 13 are energized with the same amplitude of periodic voltage, the phased relationship between the breakoff times of the first and second groups of ink jets 10 and 12, 11 and 13 will match the phase relation between the energizing signals applied to both set of energizing electrodes.

Alternatively, by energizing a first set of electrodes 50*a* and 50*c* with a periodic voltage at one phase and amplitude and energizing a second set of electrodes 50*b* and 50*d* with a periodic voltage at the same phase but a different amplitude, the first group of ink jets will breakoff at one phase and at one breakoff distance from the nozzles while the second group of jets will breakoff at a second phase and a second breakoff distance from the nozzles. The second electrode is in communication with the controller and both electrodes are synchronized to provide the electric field to the ink jets to cause the synchronous drop breakoffs within each group of ink jets, such that the first group of drop breakoffs is in a phased relationship to the second group of drop breakoffs.

In one alternative embodiment, the electrodes 14 and 50 are fabricated on a single taller plate where the spacing between the electrodes 50 and electrodes 14 is such that the drop breakoff induced by the electrodes 50 takes place in front of the electrodes 14.

While the embodiment described above employs modulating electric fields that serve as signals to stimulate drop breakoff, the signals can be of any type. For example, modulating fluid temperatures or pressures at the nozzles could be employed as signals to stimulate drop breakoff.

Alternative embodiments of stimulating device 52 will now be discussed. Stimulating device 52 can comprise a thermal stimulation device, such as is known in the art. In one example embodiment including a thermal stimulation device, resistive heaters are associated with each nozzle to heat a portion of the fluid as or prior to the fluid jetting from the nozzle. The variations in temperature produce a localized difference in fluid properties, such as surface tension, viscosity, or density, which are sufficient to cause a controlled break off of drops from the jets. The resistive heaters comprise a first and a second group of resistive heaters associated with first and second groups of ink jets, respectively. The first and second groups of resistive heaters are energized by associated electronics to produce a first group of synchronous drop breakoffs from the first group of ink jets and a second group of synchronous drop breakoffs from the second group of ink jets.

Alternatively, stimulating device 52 can comprise a microelectromechanical system (MEMS) stimulating device. For example, thin film piezoelectric, ferroelectric or electrostrictive materials such as lead zirconate titanate (PZT), lead lanthanum zirconate titanate (PLZT), or lead magnesium niobate titanate (PMNT) can be deposited using sputtering or sol gel techniques to serve as a layer that will expand or contract in response to an applied electric field as disclosed, for example, by Shimada, et al. in U. S. Pat. No. 6,387,225, issued May 14, 2002; Sumi, et al., in U. S. Pat. No. 6,511,161, issued Jan. 28, 2003; and Miyashita, et al., in U.S. Pat. No. 6,543,107, issued Apr. 8, 2003. Thermomechanical devices utilizing electroresistive materials having large coefficients of thermal expansion, such as titanium aluminide, have been disclosed as thermal actuators constructed on semiconductor substrates, for example, by Jarrold et al., in U.S. Pat. No. 6,561,627, issued May 13, 2003. As such, electromechanical devices can also be configured and fabricated using microelectronic processes to provide stimulation energy in the form of pressure modulations at the nozzles to stimulate drop breakoff. These types of devices can be configured to provide stimulation on a jet-by-jet basis.

In one example embodiment including a MEMS stimulating device, the MEMS stimulating device includes a first and a second group of MEMS devices associated with first and second groups or inkjets, respectively. The first and second groups of MEMS devices are energized by associated electronics to produce a first group of synchronous drop breakoffs from the first group of ink jets and a second group of synchronous drop breakoffs from the second group of ink jets.

The embodiments have been described in detail with particular reference to certain example embodiments thereof, but it will be understood that variations and modifications can be effected within the scope of the embodiments, especially to those skilled in the art.

Parts List

7. print receiving medium
8. printhead
9. drop generator
10. inkjets
11. ink jets
12. inkjets
13. inkjets
14. electrode
14*a*. electrode
14*b*. electrode
14*c*. electrode
14*d*. electrode
15. drop breakoff
16. drop breakoff
17. breakoff times
17*a*. breakoff times
18. breakoff times
18*a*. breakoff times
19. drop
19*a*. preceding drop
20. drop
20*a*. drop
21. drop
21*a*. drop
22. drop
22*a*. drop
23. charge plate
24. controller
25. drop creation period
27. drop selection pulse
27*a*. drop selection pulse
30. nozzle
31. nozzle

32. nozzle
33. nozzle
34. drop selection pulse
34*a*. drop selection pulse
38. timing relationship
39*a*. time
39*b*. time
50*a*. electrode
50*b*. electrode
50*c*. electrode
50*d*. electrode
51. orifice plate
52. stimulating device
90. second plate (stimulating device plate)

The invention claimed is:

1. An ink jet printing system comprising:

a printhead comprising a plurality of continuous ink jets, wherein the continuous ink jets are disposed in a row and directed toward a print receiving medium, wherein the printhead comprises:

i. a stimulating device associated with a drop generator adapted to provide a first signal to a first group of ink jets to produce first group of synchronous drop breakoffs, and then provide a second signal to a second group of ink jets to produce a second group of synchronous drop breakoffs, wherein the first group of ink jets provides the first group of synchronous drop breakoffs in a phased relationship to the second group of synchronous drop breakoffs of the second group of ink jets such that respective breakoff phases for the first and second groups of synchronous drop breakoffs are different;

ii. a charge plate disposed opposite the drop generator, wherein the charge plate comprises a plurality of drop charging electrodes, each drop charging electrode positioned adjacent an ink jet; and iii. a controller in communication with each drop charging electrode, wherein the controller supplies a plurality of synchronized controlled drop selection pulses to the drop charging electrodes, wherein the synchronized controlled drop selection pulses are applied to the drop charging electrodes associated with the first group of ink jets in a phased relationship to the drop selection pulses applied to the drop charging electrodes associated with the second group of ink jets such that the respective drop selection pulses applied to the drop charging electrodes associated with the first and second groups of ink jets are synchronized with respective breakoff times for the first and second groups of synchronous drop breakoffs, and wherein the drop selection pulses applied to the drop charging electrodes associated with the first group of ink jets controls drop charging of ink jets in the first group of ink jets without controlling drop charging of ink jets in the second group of ink jets.

2. An ink jet printing system comprising:

a printhead comprising a plurality of continuous ink jets, wherein the continuous ink jets are disposed in a row and directed toward a print receiving medium, wherein the printhead comprises:

i. a stimulating device associated with a drop generator adapted to provide a first signal to a first group of ink jets to produce first group of synchronous drop breakoffs, and then provide a second signal to a second group of ink jets to produce a second group of synchronous drop breakoffs, wherein the first group of ink jets provides the first group of synchronous drop breakoffs in a phased relationship to the second group of synchronous drop breakoffs of the second group of ink jets;

ii. a charge plate disposed opposite the drop generator, wherein the charge plate comprises a plurality of drop charging electrodes, each drop charging electrode positioned adjacent an ink jet; and iii. a controller in communication with each drop charging electrode, wherein the controller supplies a plurality of synchronized controlled drop selection pulses to the drop charging electrodes, wherein the synchronized controlled drop selection pulses are applied to the drop charging electrodes associated with the first group of ink jets in a phased relationship to the drop selection pulses applied to the drop charging electrodes associated with the second group of ink jets, wherein the drop selection pulses applied to the drop charging electrodes associated with the first group of ink jets controls drop charging of ink jets in the first group of ink jets without controlling drop charging of ink jets in the second group of ink jets, and wherein the first group of drop breakoffs is phased from 135 to 225 degrees relative to the second group of drop breakoffs.

3. The ink jet printing system of claim 1, wherein the stimulating device further provides a third signal to a third group of ink jets to produce a third group of synchronous drop breakoffs in a phased relationship to the first and second group of synchronous drop breakoffs.

4. An ink jet printing system comprising:

a printhead comprising a plurality of continuous ink jets, wherein the continuous ink jets are disposed in a row and directed toward a print receiving medium, wherein the printhead comprises;

i. a stimulating device associated with a drop generator adapted to provide a first signal to a first group of ink jets to produce first group of synchronous drop breakoffs, and then provide a second signal to a second group of ink jets to produce a second group of synchronous drop breakoffs, wherein the first group of ink jets provides the first group of synchronous drop breakoffs in a phased relationship to the second group of synchronous drop breakoffs of the second group of ink jets;

ii. a charge plate disposed opposite the drop generator, wherein the charge plate comprises a plurality of drop charging electrodes, each drop charging electrode positioned adjacent an ink jet; and iii. a controller in communication with each drop charging electrode, wherein the controller supplies a plurality of synchronized controlled drop selection pulses to the drop charging electrodes, wherein the synchronized controlled drop selection pulses are applied to the drop charging electrodes associated with the first group of ink jets in a phased relationship to the drop selection pulses applied to the drop charging electrodes associated with the second group of ink jets, wherein the drop selection pulses applied to the drop charging electrodes associated with the first group of ink jets controls drop charging of ink jets in the first group of ink jets without controlling drop charging of ink jets in the second group of ink jets, wherein the stimulating device further provides a third signal to a third group of ink jets to produce a third group of synchronous drop breakoffs in a phased relationship to the first and second group of synchronous drop breakoffs, and wherein the third group of drop breakoffs is phased from about 90 to about 150 degrees relative to the first and second group of drop breakoffs.

5. The system of claim 1, wherein each drop selection pulse comprises a pulse width that prevents interference with the drop selection pulse used for the continuous ink jets adjacent to the drop selection pulse.

6. An ink jet printing system comprising:

a printhead comprising a plurality of continuous ink lets, wherein the continuous ink jets are disposed in a row and directed toward a print receiving medium, wherein the printhead comprises:

i. a stimulating device associated with a drop generator adapted to provide a first signal to a first group of ink jets to produce first group of synchronous drop breakoffs, and then provide a second signal to a second group of ink jets to produce a second group of synchronous drop breakoffs, wherein the first group of ink jets provides the first group of synchronous drop breakoffs in a phased relationship to the second group of synchronous drop breakoffs of the second group of ink jets;

ii. a charge plate disposed opposite the drop generator, wherein the charge plate comprises a plurality of drop charging electrodes, each drop charging electrode positioned adjacent an ink jet; and iii. a controller in communication with each drop charging electrode, wherein the controller supplies a plurality of synchronized controlled drop selection pulses to the drop charging electrodes, wherein the synchronized controlled drop selection pulses are applied to the drop charging electrodes associated with the first group of ink jets in a phased relationship to the drop selection pulses applied to the drop charging electrodes associated with the second group of ink jets, wherein the drop selection pulses applied to the drop charging electrodes associated with the first group of ink jets controls drop charging of ink jets in the first group of ink jets without controlling drop charging of ink jets in the second group of ink jets, and wherein a drop creation period is formed between the first drop of a group and an additional drop of that group and the pulse width for each ink jet is 50% the drop creation period.

7. The system of claim 1, the system further comprising first and second group of control electrodes disposed on the charge plate, with at least one electrode from one of the first and second groups of control electrodes positioned adjacent each nozzle to generate an electric field that stimulates the ink jets, wherein the first group and the second group of control electrodes communicate with the controller and are synchronized in a phased relationship.

8. The system of claim 1, wherein the stimulating device comprises an electrohydrodynamic stimulating device.

9. The system of claim 1, wherein the stimulating device comprises a thermal stimulation device.

10. The system of claim 1, wherein the stimulating device comprises microelectromechanical system stimulating device.

11. The system of claim 10, microelectromechanical system stimulating device being made from a material, wherein the material comprises at least one of a piezoelectric, ferroelectric, and electrostrictive material.

12. The system of claim 10, wherein the microelectromechanical system stimulating device comprises a thermal actuator.

13. An ink jet printing system comprising:

a printhead comprising a plurality of continuous ink jets, wherein the continuous ink jets are disposed in a row and directed toward a print receiving medium, wherein the printhead comprises:

i. a stimulating device associated with a drop generator adapted to provide a first signal to a first group of ink jets to produce first group of synchronous drop breakoffs, and then provide a second signal to a second group of ink jets to produce a second group of synchronous drop breakoffs, wherein the first group of ink jets provides the first group of synchronous drop breakoffs in a phased relationship to the second group of synchronous drop breakoffs of the second group of ink jets;

ii. a charge plate disposed opposite the drop generator, wherein the charge plate comprises a plurality of drop charging electrodes, each drop charging electrode positioned adjacent an ink jet; and iii. a controller in communication with each drop charging electrode, wherein the controller supplies a plurality of synchronized controlled drop selection pulses to the drop charging electrodes, wherein the synchronized controlled drop selection pulses are applied to the drop charging electrodes associated with the first group of ink jets in a phased relationship to the drop selection pulses applied to the drop charging electrodes associated with the second group of ink jets, wherein the drop selection pulses applied to the drop charging electrodes associated with the first group of ink jets controls drop charging of ink jets in the first group of ink jets without controlling drop charging of ink jets in the second group of ink jets, and wherein the phased relationship of the drop selection pulses applied to the drop charging electrodes associated with the first group of ink jets and the drop selection pulses applied to the drop charging electrodes associated with the second group of ink jets is a 180-degree phased relationship.

14. The system claim 1, wherein the drop selection pulses applied to the drop charging electrodes associated with the second group of ink jets controls drop charging of ink jets in the second group of ink jets without controlling drop charging of ink jets in the first group of ink jets.

15. The system of claim 1, wherein ink jets of the first group of ink jets alternate with ink jets of the second group of ink jets.

16. A method for reducing cross talk in an ink jet printing system comprising:

a. forming a plurality of continuous ink jets;

b. stimulating a first group of ink jets to produce a first group of synchronous drop breakoffs;

c. stimulating a second group of ink jets to produce a second group of synchronous drop breakoffs in a phased relationship to the first group of drop breakoffs to produce drops in a phased relationship;

d. selectively charging the drops with electrodes on a charge plate wherein each electrode is individually associated with an ink jet; and e. applying drop selection pulses to the drop charging electrodes wherein the drop selection pulses are applied to the drop charging electrodes associated with the first group of ink jets in a 135 to 225 degrees phased relationship to the drop selection pulses applied to the drop charging electrodes associated with the second group of ink jets, and wherein the drop selection pulses of the first group of ink jets do not affect the drops of the second group of ink jets.

17. An ink jet printing system comprising:

a printhead comprising a plurality of continuous ink jets, wherein the continuous ink jets are disposed in a row and directed toward a print receiving medium, wherein the printhead comprises:

i. a stimulating device associated with a drop generator adapted to provide a first signal to a first group of ink jets to produce first group of synchronous drop breakoffs, and then provide a second signal to a second group of ink jets to produce a second group of synchronous drop breakoffs, wherein the first group of ink jets provides the first group of synchronous drop breakoffs in a phased relationship to the second group of synchronous drop breakoffs of the second group of ink jets;

ii. a charge plate disposed opposite the drop generator, wherein the charge plate comprises a plurality of drop charging electrodes, each drop charging electrode positioned adjacent an ink jet; and iii. a controller in communication with each drop charging electrode, wherein the controller supplies a plurality of synchronized controlled drop selection pulses to the drop charging electrodes, wherein the synchronized controlled drop selection pulses are applied to the drop charging electrodes associated with the first group of ink jets in a phased relationship to the drop selection pulses applied to the drop charging electrodes associated with the second group of ink jets, and wherein the drop selection pulses applied to the drop charging electrodes associated with the first group of ink jets controls drop charging of ink jets in the first group of inkjets without controlling drop charging of ink jets in the second group of ink jets, wherein a drop creation period is formed between the first drop of a group and an additional drop of that group and the pulse width for each ink jet is within the range of 30% to 70% of the drop creation period.

* * * * *